United States Patent [19]

Yamaguchi et al.

[11] 4,421,614

[45] Dec. 20, 1983

[54] METHOD OF BYPASSING ELECTRIC CURRENT OF ELECTROLYTIC CELLS

[75] Inventors: Kenzo Yamaguchi, Tokyo; Yoshinari Take; Akiyoshi Manabe, both of Okayama, all of Japan

[73] Assignee: Chlorine Engineers Corp. Ltd., Tokyo, Japan

[21] Appl. No.: 326,624

[22] Filed: Dec. 2, 1981

[30] Foreign Application Priority Data

Dec. 3, 1980 [JP] Japan ..... 55-169640

[51] Int. Cl.[3] ..... C25F 1/34; C25F 15/00

[52] U.S. Cl. ..... 204/98; 204/128; 204/228

[58] Field of Search ..... 204/98, 128, 228

[56] References Cited

U.S. PATENT DOCUMENTS

| | | | |
|---|---|---|---|
| 4,169,775 | 10/1979 | Kuo | 204/228 |
| 4,197,169 | 4/1980 | Zahn et al. | 204/228 |
| 4,251,334 | 2/1981 | Kircher | 204/98 |

*Primary Examiner*—R. L. Andrews

*Attorney, Agent, or Firm*—Sughrue, Mion, Zinn, Macpeak and Seas

[57] ABSTRACT

The method for bypassing the electric current of at least one cell of an electrolytic apparatus includes a series combination of a resistor and a switch connected in parallel to the terminals of the cell to be repaired or replaced. In another embodiment a plurality of said series combinations may be connected in parallel to each other and be connected in parallel to the terminals of the cell to be bypassed.

1 Claim, 3 Drawing Figures

METHOD OF BYPASSING ELECTRIC CURRENT OF ELECTROLYTIC CELLS

BACKGROUND OF THE INVENTION

The present invention is directed to a method of bypassing the electric current of at least one of a plurality of electrolytic cells which are connected in series to an electrolytic power source thus forming an electrolytic apparatus.

In an electrolytic apparatus utilizing an ion exchange membrane method or a diaphragm means for subjecting alkali metal halogenide aqueous solution or the like to electrolysis, a plurality of electrolytic cells are connected in series to an electrolytic power source. When it is desirable to repair or replace one of the electrolytic cells in such an electrolytic apparatus, it is necessary to bypass the electric current of the electrolytic cell while the remaining electrolytic calles are still operated with the rated current.

Previously, the connecting terminals of a short-circuit unit were connected to the anode and cathode terminals provided on the outer surface of the electrolytic cell, respectively, to form a bypass circuit for the electrolytic current. When the switch of the short-circuit unit was closed, the electrolytic current would flow through the short-circuit unit thereby bypassing, the current passing through the electrolytic cell. The electrolyte in the electrolytic cell can then be drained or the entire electrolytic cell removed from the electrolytic apparatus.

However, in carrying out the above-mentioned conventional method of bypassing the electric current of an electrolytic cell, when the switch of the short-circuiting unit is closed a large reverse current flows in the electrolytic cell. Although the reverse current decreases abruptly, a small reverse current will continue to flow in the electrolytic cell for a long period of time before finally approaching zero.

In the electrolysis of an alkali metal halogenide solution, a cathode is utilized which is provided for forming an active coating layer such as a porous nickel coating layer low in hydrogen overvoltage on an electrically conductive base of soft steel or the like. In has been found that the reverse current dissolves the electrically conductive base and the active coating layer of the cathode and if the reverse current flows for a long period of time, the cathode will be adversely affected thereby.

SUMMARY OF THE INVENTION

The present invention provides a new and improved method of bypassing the electric current of electrolytic cells in which the cathode base or coating layer in an electrolytic cell will be protected from the reverse current which is caused when the electric current thereto is bypassed.

The present invention provides a new and improved method of bypassing the electric current of an electrolytic cell wherein, while an electrolytic apparatus comprising a plurality of electrolytic cells connected in series to an electrolytic power source is being operated with a rated current, the electric current to at least one of the electrolytic cells is bypassed by connecting a short-circuiting unit comprising a series combination of a resistor and a switch in parallel to at least one of the electrolytic cells and closing the switch to provide a closed loop which allows a current smaller than the current flowing during the electrolysis to flow in the same direction in the cell as the direction during electrolysis.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
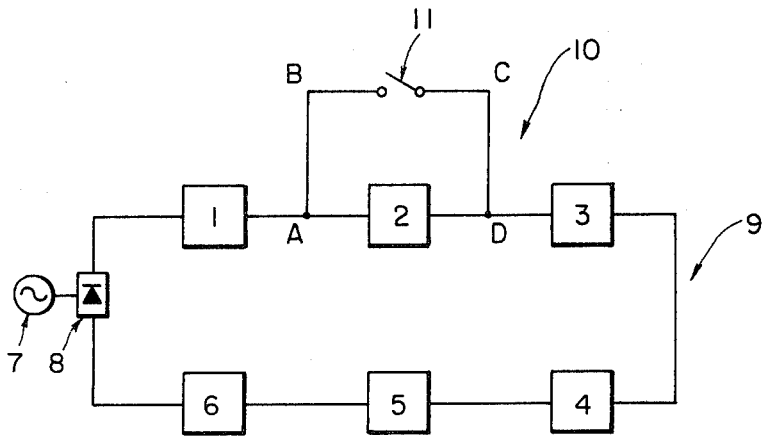
FIG. 1 PRIOR ART
FIG. 1 is a schematic circuit diagram showing a prior art system for bypassing the electric current of at least one electric cell.
Figure 2:
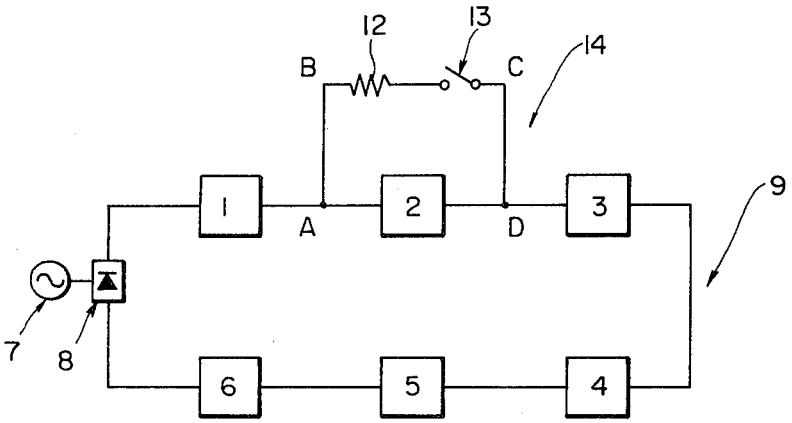
FIG. 2 is a schematic circuit diagram showing a first embodiment of a system for bypassing the electric current of at least one electrolytic cell according to the present invention.
Figure 3:
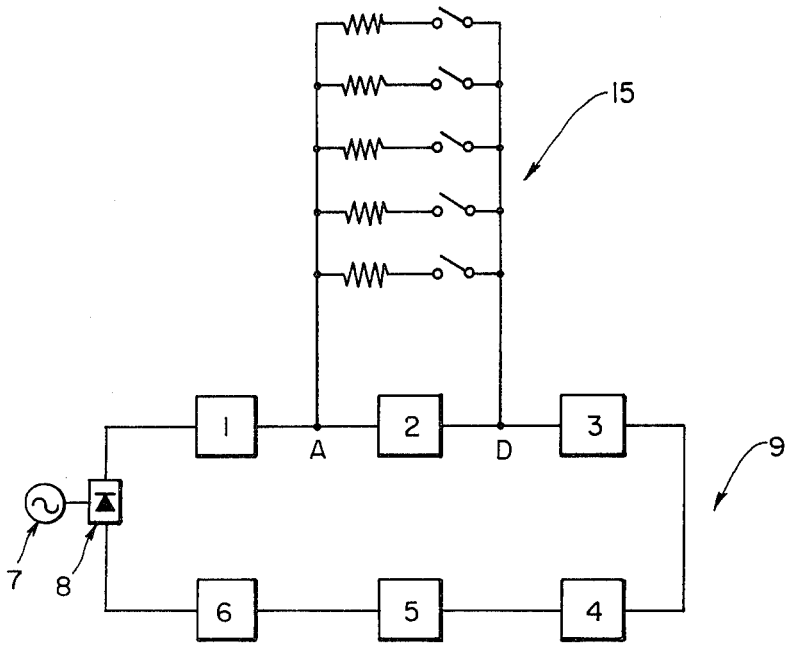
FIG. 3 is a schematic circuit diagram of a second embodiment of a system for bypassing the electric current of at least one electrolytic cell according to the present invention.

As shown in FIGS. 1–3 a plurality of electrolytic cells 1–6 of the type having an alkali metal halogenide aqueous solution are connected in series with a power source 7 and a rectifier 8 to form an electrolytic apparatus 9. In each of the systems it is assumed that one of the electrolytic cells forming the electrolytic apparatus, for example electrolytic cell 2, must be repaired or replaced. In order to accomplish the bypass of current of the electrolytic cell to be repaired or replaced, a short-circuit unit is connected in parallel to the cell to be repaired or replaced.

In accordance with the prior art system shown in FIG. 1, the short-circuiting unit 10 includes a switch 11, the terminals of which are connected to opposite sides of the electrolytic cell 2 at points A and D. Thus, when the switch 11 is closed a bypass circuit A-B-C-D is formed. As soon as the switch 11 is closed, the electrolytic current will flow in the direction A-B-C-D while the current flows through the cell in the direction D-A. The current flowing in the direction D-A is a reverse current which flows in the direction opposite to the direction of the normal electrolytic current. The reverse current decreases abruptly almost immediately after the closure of the switch 11 and gradually decreases further over a long period of time. Finally, the reverse current flowing in the direction D-A approaches zero.

In the system for bypassing the electric current of a selected electrolytic cell according to the present invention as shown in FIG. 2, a short-circuit unit 14 is comprised of a resistor 12 and a switch 13 which are in series with each other and connected in parallel to the electrolytic cell 2. At the instant the switch 13 is closed the current flows in the unit 14 in the direction A-B-C-D and temporarily through the electrolytic cell in the direction D-A. However, since the resistor 12 is provided between the circuit points B and C, the current flowing in the direction D-A is much smaller than that according to the conventional arrangement illustrated in FIG. 1. Accordingly, a steady state is soon reached in which a small amount of current flows in the direction A-D, that is, the electrolytic current is distributed in two forward directions A-B-C-D and A-D according to the resistance of the electrolytic cell 2 and the resistance of the resistor 12. Under this condition, the electrolyte in the cell may be drained or the entire electrolytic cell may be removed.

The resistance of the resistor 12 is so selected that the reverse current flowing in the direction D-A is prevented after the initial surge and a small current will continue to flow in the direction A-D. In order to effectively prevent the dissolution of the base and the coating of the cathode, the resistance of the resistor 12 is preferably selected so that the current flowing in the direction of A-D is at least 0.5 mA per $dm^2$ of the cathode of the electrolytic cell.

In the embodiment of FIG. 3 according to the present invention, the short-circuiting unit 15 is comprised of a plurality of series connected resistor and switch combinations each of which is connected in parallel with each other, and the short-circuit unit 15 is connected in parallel to the electrolytic cell 2. As the switches associated with each resistor are closed one after the other, the electrolytic current flowing in the electrolytic cell 2 is allowed to flow in the resistors in a stepwise manner. Thus, the current between the circuit points A and D decreases stepwise and, accordingly, the instantaneous reverse current flowing between the circuit points D and A can be substantially eliminated.

The method according to the present invention has been described with respect to FIGS. 2 and 3 in which the current to only one electrolytic cell is stopped. However, it will be understood that the method according to the present invention can be applied when it is desired to bypass the current of more than one electrolytic cell.

According to the present invention, the current short-circuiting unit is comprised of at least one series combination of a resistor and a switch which is connected in parallel to an electrolytic cell to be repaired or replaced. Therefore, even if the reverse current flows in the electrolytic cell momentarily when the switch is closed, the flow of the reverse current soon ceases and the deleterious effects of a reverse current which flows for a long period of time are completely avoided. When a reverse current flows for a long period of time, the base or the coating of the cathode would be dissolved. Furthermore, according to the present invention, the electrolytic current is allowed to flow in the variable resistor in a stepwise manner so that the reverse current occurring at the closure of the switch can be substantially eliminated which more effectively protects the cathode from dissolution.

This invention will be further described with respect to the following specific exampels:

EXAMPLE 1

Sodium chloride aqueous solution was subjected to electrolysis under the following conditions with an electrolytic apparatus which was formed by connecting three ion exchange membrane type electrolytic cells in series to a power source and a rectifier. Each ion exchange membrane type electrolytic cell is made up of a titanium anode coated with a platinum group metal oxide, a soft steel cathode coated with Raney nickel and a cation exchange membrane (Nafion 227 made by DuPont).

Current density (anode and cathode): 20 $A/dm^2$
Supplied sodium chloride density: 300 g/l
Concentration of caustic soda extracted from the cathode chamber: 22%
Electrolyte temperature: 80° C.

A current bypassing unit or short-circuiting unit comprised of a 0.088 Ohm resistor and a switch was connected in parallel to one of the ion exchange membrane type electrolytic cells in the electrolytic apparatus. When the switch was closed, a reverse current of 0.1 $A/dm^2$ flowed in the electrolytic cell momentarily. However, the reverse current decreased quickly and in 0.5 seconds a forward current of 0.1 $A/dm^2$ was flowing.

After this operation was repeated 10 times the ion exchange membrane type electrolytic cell was removed and its cathode was taken out to measure the cathode potential. The measured cathode potential was substantially equal to that which was measured before the operation. The surface of the cathode was observed with an X-ray microanalyzer and it was found that the composition of the coating layer was not affected at all.

EXAMPLE 2

Electrolysis was carried out with an electrolytic apparatus similar to that in Example 1 under the same conditions as those in Example 1. A current bypassing unit or short-circuit unit with selectable resistors which were so designed that the resistance could be change stepwise from 0.11 Ohms to 0.085 Ohms was connected in parallel to one of the ion exchange membrane type electrolytic cells. By closing the switches one after another, the electrolytic current was allowed to flow in the selectable reistors in a stepwise manner. In this case, the reverse current flowing in the electrolytic cell instantaneously was limited to 0.01 $A/dm^2$ and in 0.1 seconds a forward current of 10 $mA/dm^2$ was flowing.

After this operation was repeated 10 times the ion exchange membrane type electrolytic cell was removed and its cathode taken out to measure the cathode potential. The measured cathode potential was substantially equal to that which was measured before the operation. The surface of the cathode was observed with an X-ray microanalyzer and it was found that the composition of the coating layer was not affected at all.

COMPARATIVE PRIOR ART EXAMPLE 1

Electrolysis was carried out with an electrolytic apparatus similar to that in Example 1 under the same conditions as those in Example 1. A short-circuiting unit such as that shown in FIG. 1 was connected to one of the ion exchange membrane type electrolytic cells. When the switch of the short-circuiting unit was closed a reverse current of 10 $A/dm^2$ flowed in the electrolytic cell momentarily. Although the reverse current decreased abruptly, the decreased reverse current flowed for along period of time. Even after 120 minutes a reverse current of 20 $mA/dm^2$ flowed.

After this operation was repeated 5 times, the electrolytic cell was removed and the cathode was taken out to measure the cathode potential. The hydrogen overvoltage was increased by more than 100 mV. Upon observation of the cathode surface with an X-ray microanalyzer it was found that the coating layer was dissolved.

EXAMPLE 3

An electrolytic apparatus was provided by connecting six diaphragm type electrolytic cells in series to a power source and a rectifier. Each electrolytic cell was made up of a titanium anode coated with a platinum group metal oxide, a nickel-coated soft steel cathode and asbestos diaphragms combined with a fluoro resin.

In the operation of the electrolytic apparatus the sodium chloride aqueous solution in each electrolytic cell was subjected to electrolysis under the following conditions:

Current density (anode and cathode): 20 A/dm$^2$
Supplied sodium chloride: 313 g/l
Concentration of caustic soda extracted from the cathode chamber: 10.5%
Electrolyte temperature: 85° C.

A current bypassing or short-circuiting unit comprising a 0.10 Ohm resistor and a switch was connected in parallel to one of the electrolytic cells. When the switch was closed a reverse current of 0.1 A/dm$^2$ flowed in the electrolytic cell momentarily. The reverse current decreased abruptly and in 0.5 seconds a forward current of 7 mA/dm$^2$ was flowing. After this operation was repeated 10 times, the diaphragm type electrolytic cell was removed and its cathode was taken out to measure the cathode potential. The measured cathode potential was substantially equal to that which was measured before the operation. Upon observation of the cathode surface with an X-ray microanalyzer, it was found that the composition of the coating layer was not affected at all.

EXAMPLE 4

Electrolysis was carried out with an electrolytic device similar to that in Example 3 under the same conditions as those in Example 3. A current bypassing or short-circuiting unit was fabricated with selectable resistors and switches so that the resistance could be changed stepwise from 0.11 Ohms to 0.085 Ohms. The current bypassing unit was connected in parallel with one of the diaphragm type electrolytic cells. By closing the switches one after another, the electrolytic current flowing in the electrolytic cell was allowed to flow in the resistors. The reverse current flowing in the electrolytic cell instantaneously was limited to 0.01 A/dm$^2$ maximum and in 0.1 seconds a forward current of 1 mA/dm$^2$ was flowing.

After this operation was repeated 10 times, the electrolytic cell was removed and the cathode was taken out to measure the cathode potantial. The measured cathode potential was completely equal to that which was measured before the operation. Upon observation of the cathode surface with an X-ray microanalyzer, it was found that the composition of the coating layer was maintained unchanged.

COMPARATIVE PRIOR ART EXAMPLE 2

Electrolysis was carried out with an electrolytic apparatus similar to that in Example 3 under the same conditions as those in Example 3. The short-circuiting unit similar to that of FIG. 1 was connected in parallel to one of the diaphragm type electrolytic cells. When the switch of the short-circuiting unit was closed, a reverse current of 10 A/dm$^2$ flowed in the electrolytic cell instantaneously. Although the reverse current was descreased abruptly, the decreased reverse current still flowed for along period of time. Even after 120 minutes, a reverse current of 20 mA/dm$^2$ was flowing in the electrolytic cell.

After this operation was repeated 5 times, the electrolytic cell was removed and its cathode was taken out to measure the cathode potential. The hydrogen overvoltage was increased by more than 150 mV. Upon observation of the cathode surface with an X-ray microanalyzer, it was found that it was dissolved considerably.

While the invention has been particularly shown and described with reference to preferred embodiments thereof, it will be understood by those in the art that the foregoing and other changes in form and details may be made therein without departing from the spirit and scope of the invention.

What is claimed is:

1. A method of bypassing the electric current of at least one electrolytic cell in an electrolytic apparatus comprised of a plurality of electrolytic cells having an alkaline metal halogenide aqueous solution connected in series to an electrolytic power source and operating with a rated current, comprising connecting an electric current bypass unit in parallel to at least one of said electrolytic cells which is to be bypassed, said bypass unit being comprised of a plurality of series combinations of a resistor and a switch connected in parallel with each other, and closing said switches in sequence to reduce the current in said at least one electrolytic cell in a step-wise manner thereby permitting a current smaller than the current flowing during the electrolysis to flow in the same direction as the current flows during electrolysis.

* * * * *